US010241431B2

(12) United States Patent
Yamauchi et al.

(10) Patent No.: US 10,241,431 B2
(45) **Date of Patent: *Mar. 26, 2019**

(54) TONER

(71) Applicant: KYOCERA Document Solutions Inc., Osaka (JP)

(72) Inventors: Kohei Yamauchi, Osaka (JP); Hiroki Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/806,422

(22) Filed: Nov. 8, 2017

(65) Prior Publication Data

US 2018/0149991 A1 May 31, 2018

(30) Foreign Application Priority Data

Nov. 25, 2016 (JP) ..... 2016-229065

(51) Int. Cl.
*G03G 9/08* (2006.01)
*G03G 9/087* (2006.01)

(52) U.S. Cl.
CPC ..... *G03G 9/08782* (2013.01); *G03G 9/0819* (2013.01); *G03G 9/08708* (2013.01); *G03G 9/08711* (2013.01); *G03G 9/08755* (2013.01)

(58) Field of Classification Search
CPC ..... G03G 9/08755; G03G 9/08708; G03G 9/08711; G03G 9/08782
USPC ..... 430/108.4, 109.4
See application file for complete search history.

(56) References Cited

FOREIGN PATENT DOCUMENTS

JP 2015-004722 A 1/2015

*Primary Examiner* — Mark A Chapman
(74) *Attorney, Agent, or Firm* — Studebaker & Brackett PC

(57) ABSTRACT

Toner particles contain a non-crystalline polyester resin. The toner particles further contain 10 parts by mass to 30 parts by mass of a crystalline polyester resin, 30 parts by mass to 50 parts by mass of a styrene-acrylic acid-based resin, and 8 parts by mass to 15 parts by mass of an ester wax relative to 100 parts by mass of the non-crystalline polyester resin. The crystalline polyester resin includes a repeating unit derived from an acrylic acid-based monomer and a repeating unit derived from a styrene-based monomer. The styrene-acrylic acid-based resin includes a repeating unit derived from an acrylic acid-based monomer having an amino group and has an amino group ratio of 40% to 60%. The ester wax in the toner particles has a dispersion diameter of 500 nm to 1,000 nm.

6 Claims, 1 Drawing Sheet

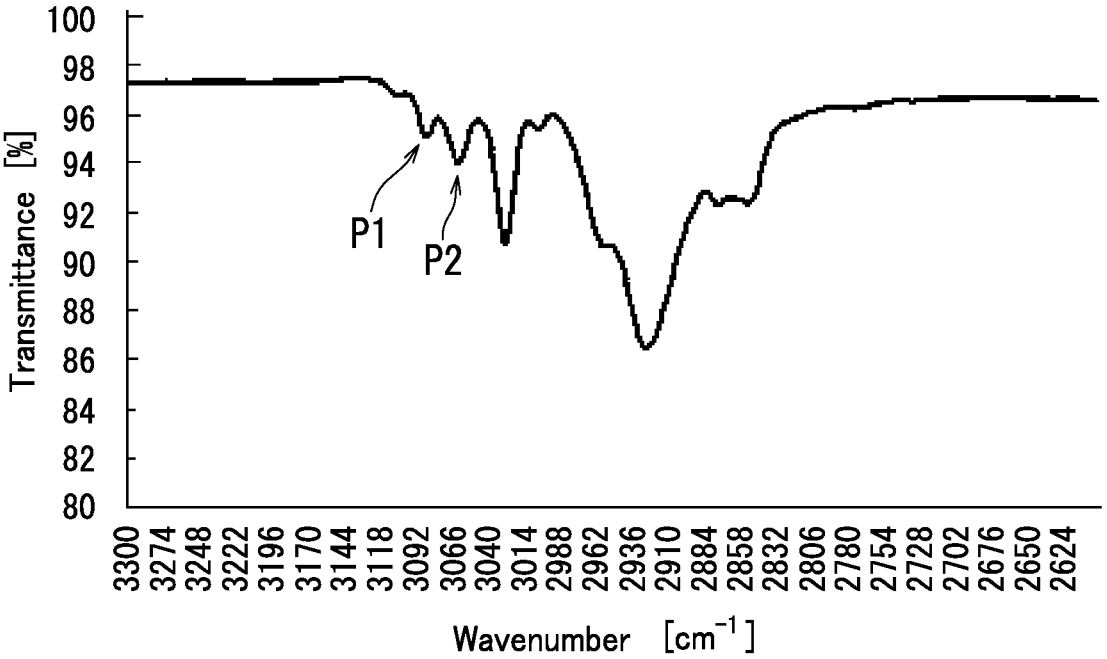
100
98
96
94
92
90
88
86
84
82
80
Transmittance [%]
P1
P2
3300
3274
3248
3222
3196
3170
3144
3118
3092
3066
3040
3014
2988
2962
2936
2910
2884
2858
2832
2806
2780
2754
2728
2702
2676
2650
2624
Wavenumber [cm$^{-1}$]

TONER

INCORPORATION BY REFERENCE

The present application claims priority under 35 U.S.C. § 119 to Japanese Patent Application No. 2016-229065, filed on Nov. 25, 2016. The contents of this application are incorporated herein by reference in their entirety.

BACKGROUND

The present disclosure relates to a toner.

In one example, toner particles contain a non-crystalline polyester resin, a crystalline polyester resin, and a styrene-acrylic acid resin.

SUMMARY

A toner according to the present disclosure includes a plurality of toner particles containing a non-crystalline polyester resin and an ester wax. The toner particles further contain at least 10 parts by mass and no greater than 30 parts by mass of a crystalline polyester resin and at least 30 parts by mass and no greater than 50 parts by mass of a styrene-acrylic acid-based resin relative to 100 parts by mass of the non-crystalline polyester resin. The crystalline polyester resin includes a first repeating unit derived from an acrylic acid-based monomer and a second repeating unit derived from a styrene-based monomer. The styrene-acrylic acid-based resin includes a third repeating unit derived from an acrylic acid-based monomer having an amino group and a fourth repeating unit derived from a styrene-based monomer. An intensity of a peak from an amino group of the third repeating unit is at least 40% and no greater than 60% of an intensity of a peak from an aromatic ring of the fourth repeating unit on an FT-IR spectrum of the toner measured by an attenuated total reflection (ATR) method. An amount of the ester wax in the toner particles is at least 8 parts by mass and no greater than 15 parts by mass relative to 100 parts by mass of the non-crystalline polyester resin. The ester wax in the toner particles has a dispersion diameter of at least 500 nm and no greater than 1,000 nm.

BRIEF DESCRIPTION OF THE DRAWINGS

FIG. is a spectral chart showing an FT-IR spectrum measured with respect to a toner according to an embodiment of the present disclosure.

DETAILED DESCRIPTION

The following describes an embodiment of the present disclosure. Evaluation results (for example, values indicating a shape and physical properties) for a powder (specific examples include toner mother particles, an external additive, and a toner) are each a number average of values measured for a suitable number of average particles selected from the particles included in the powder, unless otherwise stated.

A number average particle diameter of a powder is a number average of equivalent circle diameters of primary particles (Heywood diameters: diameters of circles having the same area as projections of the particles) measured using a microscope, unless otherwise stated. A value for volume median diameter ($D_{50}$) of a powder is measured using a laser diffraction/scattering particle size distribution analyzer ("LA-750", product of Horiba, Ltd.), unless otherwise stated. Acid values and hydroxyl values are measured in accordance with "Japanese Industrial Standard (JIS) K0070-1992", unless otherwise stated. Values for number average molecular weight (Mn) and mass average molecular weight (Mw) are measured by gel permeation chromatography, unless otherwise stated.

A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) measured using the differential scanning calorimeter during the second heating, the glass transition point (Tg) corresponds to a temperature (onset temperature) at a point of change in specific heat (i.e., an intersection point of an extrapolation line of a base line and an extrapolation line of an inclined portion of the curve). A value for a softening point (Tm) is measured using a capillary rheometer ("CFT-500D", product of Shimadzu Corporation), unless otherwise stated. On an S-shaped curve (vertical axis: temperature, horizontal axis: stroke) measured using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) measured using a differential scanning calorimeter ("DSC-6220", product of Seiko Instruments Inc.), unless otherwise stated.

The term chargeability refers to chargeability in triboelectric charging, unless otherwise stated. Strength of positive chargeability (or strength of negative chargeability) in triboelectric charging can be confirmed by for example a known triboelectric series.

SP values (solubility parameter) are calculated (unit: $(cal/cm^3)^{1/2}$, temperature: 25° C.) in accordance with the Fedors estimation method (R. F. Fedors, "Polymer Engineering Science", 14(2), p 147-154 (1974)), unless otherwise stated. An SP value is represented by the formula "SP value=$(E/V)^{1/2}$" (E: molecular cohesive energy [cal/mol], V: molecular volume [$cm^3$/mol]).

The term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth)acrylonitrile" may be used as a generic term for both acrylonitrile and methacrylonitrile.

The toner according to the present embodiment is for example suitable for use as a positively chargeable toner for developing an electrostatic latent image. The toner according to the present embodiment is a powder including a plurality of toner particles (particles each having the feature described below). The toner may be used as a one-component developer. Alternatively, a two-component developer may be prepared by mixing the toner and a carrier using a mixer (for example, a ball mill). In order to achieve high quality image formation, a ferrite carrier is preferably used as the carrier. In order to achieve high quality image formation over an extended period of time, magnetic carrier particles including carrier cores and resin layers coating the carrier cores are preferably used. In order that carrier particles are magnetic, carrier cores thereof may be formed from a magnetic material (for example, ferromagnetic material such as ferrite) or formed from a resin in which magnetic particles are dispersed. Alternatively, in order that carrier particles are magnetic, magnetic particles may be dispersed in resin layers coating carrier cores thereof. Preferably, the amount of the toner in the two-component developer is at least 5 parts by mass and no greater than 15 parts by mass relative to 100 parts by mass of the carrier in order to achieve high quality image formation. Note that a positively chargeable toner included in a two-component developer is positively charged by friction against a carrier therein.

The toner according to the present embodiment can for example be used in image formation in an electrophotographic apparatus (image forming apparatus). The following describes an example of image forming methods that are performed by electrophotographic apparatuses.

First, an image forming section (for example, a charger and a light exposure device) of an electrophotographic apparatus forms an electrostatic latent image on a photosensitive member (for example, on a surface of a photosensitive drum) based on image data. Next, a developing device (more specifically, a developing device having a toner-containing developer loaded therein) of the electrophotographic apparatus supplies the toner to the photosensitive member to develop the electrostatic latent image formed on the photosensitive member. The toner is charged by friction with the carrier or a blade in the developing device before being supplied to the photosensitive member. For example, a positively chargeable toner is positively charged. In the developing step, the toner (more specifically, the charged toner) on the development sleeve (for example, a surface of a development roller in the developing device) disposed in the vicinity of the photosensitive member is supplied to the photosensitive member and caused to adhere to the electrostatic latent image on the photosensitive member, so that a toner image is formed on the photosensitive member. Toner is supplied to the developing device from a toner container containing toner for replenishment use to make up for consumed toner.

Subsequently, in a transfer step, a transfer device of the electrophotographic apparatus transfers the toner image on the photosensitive member onto an intermediate transfer member (for example, a transfer belt), and then further transfers the toner image from the intermediate transfer member onto a recording medium (for example, paper). Next, a fixing device (fixing method: nip fixing in which fixing is performed through a nip between a heating roller and a pressure roller) of the electrophotographic apparatus fixes the toner to the recording medium by applying heat and pressure to the toner. Through the above, an image is formed on the recording medium. A full-color image can for example be formed by superimposing toner images of four different colors: black, yellow, magenta, and cyan. After the transfer process, toner left on the photosensitive member is removed by a cleaning member (for example, a cleaning blade). A direct transfer process may alternatively be employed, which involves direct transfer of the toner image on the photosensitive member to the recording medium without the use of the intermediate transfer member. A belt fixing process may alternatively be employed, in which fixing is performed using a belt.

The toner according to the present embodiment includes a plurality of toner particles. The toner particles may include an external additive. In a configuration in which the toner particles each include the external additive, the toner particles each include a toner mother particle and the external additive. The external additive adheres to the surfaces of the toner mother particles. The toner mother particles contain a binder resin and a releasing agent. The toner mother particles may contain, in addition to the binder resin and the releasing agent, optional internal additives (for example, at least one of a colorant, a charge control agent, and a magnetic powder). The external additive may be omitted if unnecessary. In a situation in which the external additive is omitted, the toner mother particles are equivalent to the toner particles.

The toner particles included in the toner according to the present embodiment may be toner particles having no shell layers (hereinafter, referred to as non-capsule toner particles) or may be toner particles having shell layers (hereinafter, referred to as capsule toner particles). In each of the capsule toner particles, a toner mother particle includes a toner core and a shell layer disposed over a surface of the toner core. The shell layer is substantially composed of a resin. Both heat-resistant preservability and low-temperature fixability of the toner can be achieved for example by using low-melting toner cores and covering each core with a highly heat-resistant shell layer. An additive may be dispersed in the resin forming the shell layer. The shell layer may entirely cover the surface of each toner core or partially cover the surface of each toner core. The shell layer may be substantially composed of a thermosetting resin, may be substantially composed of a thermoplastic resin, or may include both a thermoplastic resin and a thermosetting resin.

The non-capsule toner particles can for example be prepared by a pulverization method or an aggregation method. These methods facilitate sufficient dispersion of internal additives in the binder resin of the non-capsule toner particles. It is known in the art to which the present disclosure belongs that toners are broadly classified as being pulverized toners and as being polymerized toners (referred to also as chemical toner). Toners obtained by a pulverization method are classified as being pulverized toners. Toners obtained by an aggregation method are classified as being polymerized toners.

In one example of the pulverization method, the binder resin, the colorant, the charge control agent, and the releasing agent are first mixed together. Next, the resultant mixture is melt-kneaded using a melt-kneader (for example, a single or twin screw extruder). Subsequently, the resultant melt-knead product is pulverized, and the resultant pulverized product is classified. Through the above, toner mother particles are obtained. The toner mother particles tend to be prepared more easily by the pulverization method than by the aggregation method.

In one example of the aggregation method, fine particles of the binder resin, the releasing agent, the charge control agent, and the colorant are caused to aggregate in an aqueous medium containing the aforementioned fine particles until particles of a desired diameter are obtained. Through the above, aggregated particles of the binder resin, the releasing agent, the charge control agent, and the colorant are formed. Next, the aggregated particles are heated in order to cause components contained in the aggregated particles to coalesce. The above process yields toner mother particles having a desired particle diameter.

For producing capsule toner particles, shell layers may be formed by any method. For example, the shell layers may be formed according to an in-situ polymerization process, an in-liquid curing film coating process, or a coacervation process.

The toner according to the present embodiment is an electrostatic latent image developing toner having the following feature (hereinafter, referred to as the basic feature).

(Basic Feature of Toner)

The toner includes a plurality of toner particles containing a non-crystalline polyester resin and an ester wax. The toner particles further contain at least 10 parts by mass and no greater than 30 parts by mass of a crystalline polyester resin and at least 30 parts by mass and no greater than 50 parts by mass of a styrene-acrylic acid-based resin relative to 100 parts by mass of the non-crystalline polyester resin. The crystalline polyester resin includes a first repeating unit derived from an acrylic acid-based monomer and a second repeating unit derived from a styrene-based monomer. The styrene-acrylic acid-based resin includes a third repeating unit derived from an acrylic acid-based monomer having an amino group and a fourth repeating unit derived from a styrene-based monomer. On an FT-IR spectrum of the toner measured by an attenuated total reflection (ATR) method, the intensity of a peak (the height of a peak) from the amino group of the third repeating unit is at least 40% and no greater than 60% of the intensity of a peak (the height of a peak) from an aromatic ring of the fourth repeating unit. The amount of the ester wax in the toner particles is at least 8 parts by mass and no greater than 15 parts by mass relative to 100 parts by mass of the non-crystalline polyester resin. The ester wax in the toner particles has a dispersion diameter of at least 500 nm and no greater than 1,000 nm.

A vinyl compound is a repeating unit that is formed into a resin by addition polymerization through carbon-to-carbon double bonds "C═C" ("C═C"→"—C—C—"). The vinyl compound refers to a compound having a vinyl group ($CH_2$═CH—) or a substituted vinyl group in which hydrogen is replaced. Examples of vinyl compounds that can be used include ethylene, propylene, butadiene, vinyl chloride, acrylic acid, an acrylic acid ester, methacrylic acid, a methacrylic acid ester, acrylonitrile, and styrene.

The dispersion diameter of the ester wax in the toner particles refers to a number average of equivalent circle diameters of ester wax domains in cross-sectional images of the toner particles.

Hereinafter, the ratio of the intensity of the peak from the amino group of the third repeating unit to the intensity of the peak from the aromatic ring of the fourth repeating unit on the FT-IR spectrum of the toner measured by the ATR method may be referred to as an amino group ratio. The intensity of a peak is equivalent to a distance from the summit of the peak to the base line. For example, suppose a baseline transmittance is 97% and the transmittance at the summit of a peak is 94% on the FT-IR spectrum of the toner, the intensity of the peak is 3% (=97%−94%). In a situation in which the intensity of the peak from the aromatic ring of the fourth repeating unit is 3.0%, the requirement that the amino group ratio is at least 40% and no greater than 60% is satisfied so long as the intensity of the peak from the amino group of the third repeating unit is at least 1.2% and no greater than 1.8%. The FT-IR spectrum is measured by the same method as a method indicated in the Examples explained further below or according to an alternative thereof.

FIG. shows an example of the FT-IR spectrum of the toner having the above-described feature. The FT-IR spectrum (vertical axis: transmittance, horizontal axis: wavenumber) shown in FIG. includes a peak P1 from the amino group of the third repeating unit and a peak P2 from the aromatic ring of the fourth repeating unit.

In the toner having the above-described feature, the toner particles contain a crystalline polyester resin and a non-crystalline polyester resin. As a result of the toner particles containing a crystalline polyester resin, the toner particles are sharp-melting. As a result of the toner particles being sharp-melting, the toner tends to be excellent in both heat-resistant preservability and low-temperature fixability.

However, a toner whose toner particles contain a crystalline polyester resin tends to have reduced elasticity. In a situation in which the toner has reduced elasticity, hot offset tends to easily occur, and pulverizing performance of the toner tends to be reduced. In order to increase elasticity of the toner, therefore, a non-crystalline polyester resin having a low softening point (Tm) may be included in the toner particles. However, as a result of the toner particles including a non-crystalline polyester resin having a low softening point (Tm), the toner tends to have reduced low-temperature fixability.

In the toner having the above-described feature, the toner particles contain a styrene-acrylic acid-based resin in addition to a crystalline polyester resin and a non-crystalline polyester resin. The present inventor has found that pulverizing performance of the toner can be improved by including a crystalline polyester resin, a non-crystalline polyester resin, and a styrene-acrylic acid-based resin in the toner particles. The reason for the above is thought to be that the toner including such toner particles has increased pulverizing interfaces.

In the toner having the above-described basic feature, the toner particles contain at least 10 parts by mass and no greater than 30 parts by mass of a crystalline polyester resin and at least 30 parts by mass and no greater than 50 parts by mass of a styrene-acrylic acid-based resin relative to 100 parts by mass of the non-crystalline polyester resin. As a result of the toner particles containing each resin in an appropriate amount, it is possible to improve pulverizing performance and low-temperature fixability of the toner while inhibiting insufficient dispersion of toner components (internal additives). If the amount of the crystalline polyester resin is too small, the toner tends to have poor low-temperature fixability. If the amount of the crystalline polyester resin is too large, the toner tends to have poor pulverizing performance. If the amount of the styrene-acrylic acid-based resin is too small, the toner tends to have poor pulverizing performance. If the amount of the styrene-acrylic acid-based resin is too large, dispersion of toner components (internal additives) tends to be insufficient.

The crystalline polyester resin, the non-crystalline polyester resin, and the styrene-acrylic acid-based resin, which are commonly used as toner materials, are not compatible with one another. The mere use of a combination of these three resins as a binder resin of the toner particles therefore easily leads to insufficient dispersion of toner components (internal additives). Insufficient dispersion of toner components tends to lead to poor low-temperature fixability of the toner. In general, the binder resin of the toner particles has an SP value of at least 9 and no greater than 12. In one example, a crystalline polyester resin (for example, a copolymer of an α,ω-alkanediol and an α,ω-alkanedicarboxylic acid) has an SP value of approximately 10.2. In one example, a non-crystalline polyester resin (for example a polymer of a bisphenol and an aromatic dicarboxylic acid) has an SP value of approximately 11.0. In one example, a styrene-acrylic acid-based resin (for example, a polymer of styrene and an acrylic acid ester) has an SP value of approximately 9.3.

In the toner having the above-described feature, the crystalline polyester resin includes the first repeating unit derived from an acrylic acid-based monomer and the second repeating unit derived from a styrene-based monomer, and the styrene-acrylic acid-based resin includes the third repeating unit derived from an acrylic acid-based monomer having an amino group and the fourth repeating unit derived from a styrene-based monomer. The amino group ratio in the styrene-acrylic acid-based resin is at least 40% and no greater than 60%. Since each of the crystalline polyester resin and the styrene-acrylic acid-based resin includes a styrene-acrylic acid-based unit (the first and second repeating units in the crystalline polyester resin, and the third and fourth repeating units in the styrene-acrylic acid-based resin), and the amino group ratio in the styrene-acrylic acid-based resin is at least 40% and no greater than 60%, the SP value of the crystalline polyester resin, the SP value of the non-crystalline polyester resin, and the SP value of the styrene-acrylic acid-based resin are close to one another to an appropriate degree. As a result of the crystalline polyester resin, the non-crystalline polyester resin, and the styrene-acrylic acid-based resin being compatible with one another to an appropriate degree, it is possible to improve pulverizing performance of the toner while inhibiting insufficient dispersion of toner components (internal additives). As the amino group ratio in the styrene-acrylic acid-based resin increases, the SP value of the styrene-acrylic acid-based resin tends to increase, and compatibility between the crystalline polyester resin, the non-crystalline polyester resin, and the styrene-acrylic acid-based resin tends to increase. As the amino group ratio in the styrene-acrylic acid-based resin decreases, the SP value of the styrene-acrylic acid-based resin tends to decrease, and compatibility between the crystalline polyester resin, the non-crystalline polyester resin, and the styrene-acrylic acid-based resin tends to decrease.

The present inventor has found that by including an ester wax in the toner particles in addition to the binder resin (the crystalline polyester resin, the non-crystalline polyester resin, and the styrene-acrylic acid-based resin) as defined by the above-described basic feature, it is possible to achieve not only an appropriate degree of compatibility between the crystalline polyester resin, the non-crystalline polyester resin, and the styrene-acrylic acid-based resin but also an appropriate degree of compatibility between the binder resin and the releasing agent (ester wax). As a result of the amino group ratio in the styrene-acrylic acid-based resin being at least 40% and no greater than 60%, the SP value of the binder resin and the SP value of the ester wax (releasing agent) are far from each other to an appropriate degree, and the ester wax (releasing agent) disperses in the toner particles to an appropriate degree, having an appropriate dispersion diameter. As a result of the binder resin and the ester wax having an appropriate degree of compatibility, the ester wax in the toner particles can have an appropriate dispersion diameter (more specifically, at least 500 nm and no greater than 1,000 nm). If the amino group ratio in the styrene-acrylic acid-based resin is too large, compatibility between the binder resin and the ester wax (releasing agent) tends to be insufficient, and the releasing agent tends to have a too large dispersion diameter. If the releasing agent has a too large dispersion diameter, the toner tends to easily aggregate during storage. If the amino group ratio in the styrene-acrylic acid-based resin is too small, compatibility between the binder resin and the ester wax (releasing agent) tends to be too high, and the releasing agent tends to have a too small dispersion diameter. If the releasing agent has a too small dispersion diameter, the toner tends to have insufficient hot offset resistance. In the toner having the above-described basic feature, the amount of the ester wax in the toner particles is at least 8 parts by mass and no greater than 15 parts by mass relative to 100 parts by mass of the non-crystalline polyester resin, and the dispersion diameter of the ester wax in the toner particles is at least 500 nm and no greater than 1,000 nm. It is possible to improve releasability of the toner (and thus improve hot offset resistance of the toner) by dispersing a sufficient amount of releasing agent (ester wax) in the toner particles such that the releasing agent has a sufficient dispersion diameter. If the amount of the releasing agent is too large or the releasing agent has a too large dispersion diameter, the releasing agent easily detaches from the toner particles. The detached releasing agent may cause aggregation of the toner during storage, and occurrence of fogging and contamination of the inside of the apparatus upon image formation.

The following describes a composition of the non-capsule toner particles. More specifically, the following describes, in order, toner mother particles (a binder resin and internal additives) and an external additive. The following toner mother particles of the non-capsule toner particles can be used as toner cores for capsule toner particles.

[Toner Mother Particles]

The toner mother particles contain a binder resin and a releasing agent. The toner mother particles may contain other internal additives (for example, a colorant, a charge control agent, and a magnetic powder).

(Binder Resin)

The binder resin is typically a main component (for example, at least 85% by mass) of the toner mother particles. Accordingly, properties of the binder resin are thought to have a great influence on overall properties of the toner mother particles. The toner mother particles have a higher tendency to be anionic in a situation in which the binder resin has, for example, an ester group, a hydroxyl group, an ether group, an acid group, or a methyl group, and have a higher tendency to be cationic in a situation in which the binder resin has, for example, an amino group.

In the toner having the above-described basic feature, the toner mother particles contain, as the binder resin, a crystalline polyester resin, a non-crystalline polyester resin, and a styrene-acrylic acid-based resin.

A polyester resin can be synthesized through polycondensation of at least one polyhydric alcohol with at least one polycarboxylic acid. Examples of alcohols that can be preferably used in synthesis of the polyester resin include dihydric alcohols (specific examples include aliphatic diols and bisphenols) and tri- or higher-hydric alcohols listed below. Examples of carboxylic acids that can be preferably used in synthesis of the polyester resin include di-, tri-, and higher-basic carboxylic acids listed below.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl- 1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The styrene-acrylic acid-based resin is a copolymer of at least one styrene-based monomer and at least one acrylic acid-based monomer. Examples of styrene-based monomers and acrylic acid-based monomers that can be preferably used for synthesis of the styrene-acrylic acid-based resin are listed below.

Examples of preferable styrene-based monomers include styrene, alkylstyrenes (specific examples include α-methylstyrene, p-ethylstyrene, and 4-tert-butylstyrene), p-hydroxy styrene, m-hydroxy styrene, α-chlorostyrene, o-chlorostyrene, m-chlorostyrene, and p-chlorostyrene.

Examples of preferable acrylic acid-based monomers include (meth)acrylic acid, (meth)acrylonitrile, alkyl (meth) acrylates, and hydroxyalkyl (meth)acrylates. Examples of the alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

The non-crystalline polyester resin (the binder resin) is preferably a non-crystalline polyester resin containing 1,2-propanediol as the alcohol component, and is particularly preferably a polymer of 1,2-propanediol, at least one aromatic dicarboxylic acid (for example, terephthalic acid), and at least one tribasic carboxylic acid (for example, trimellitic acid). A tri- or higher-basic carboxylic acid (for example, trimellitic acid) functions as a cross-linking agent.

The 1,2-propanediol that is particularly preferable for synthesis of the non-crystalline polyester resin (the binder resin) is plant-derived 1,2-propanediol. The plant-derived 1,2-propanediol is for example produced through chemical synthesis, fermentation, or a combination of chemical synthesis and fermentation. In one example of production of plant-derived 1,2-propanediol, glycerin is obtained through hydrolysis of plant biomass including saccharides, such as glucose. Next, a reaction of glycerin and hydrogen is caused to yield plant-derived 1,2-propanediol. Plant biomass that can be used is for example at least one vegetable oil selected from the group consisting of soya oil, coconut oil, palm oil, castor oil, and cocoa oil. The plant biomass may be hydrolyzed by a chemical method using an acid or a base, by a biological method using enzyme or a microorganism, or by other methods.

According to the above-described "basic feature of the toner", the crystalline polyester resin includes the first repeating unit derived from an acrylic acid-based monomer and the second repeating unit derived from a styrene-based monomer. Particularly preferably, the crystalline polyester resin (the binder resin) is a polymer of at least one α,ω-alkanediol (for example, 1,4-butanediol and 1,6-hexanediol), at least one dibasic carboxylic acid (for example, fumaric acid), at least one styrene-based monomer (for example, styrene), and at least one alkyl (meth)acrylate (for example, n-butyl methacrylate).

According to the above-described "basic feature of the toner", the styrene-acrylic acid-based resin includes the third repeating unit derived from an acrylic acid-based monomer having an amino group and the fourth repeating unit derived from a styrene-based monomer. Preferably, the styrene-acrylic acid-based resin (the binder resin) is a cross-linked styrene-acrylic acid-based resin. Particularly preferably, the styrene-acrylic acid-based resin (the binder resin) is a polymer of at least one styrene-based monomer (for example, styrene), at least one aminoalkyl (meth)acrylate (specific examples include aminoethyl acrylate), and at least one cross-linking agent (for example, divinylbenzene).

(Colorant)

The toner mother particles may contain a colorant. A known pigment or dye matching a color of the toner can be used as a colorant. In order that the toner is suitable for image formation, the amount of the colorant is preferably at least 1 part by mass and no greater than 20 parts by mass relative to 100 parts by mass of the binder resin.

The toner mother particles may contain a black colorant. Carbon black can for example be used as a black colorant. Alternatively, a colorant that is adjusted to a black color using a yellow colorant, a magenta colorant, and a cyan colorant can be used as a black colorant.

The toner mother particles may include a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

In the toner having the above-described basic feature, the toner mother particles contain an ester wax as a releasing agent. The amount of the ester wax in the toner particles is at least 8 parts by mass and no greater than 15 parts by mass relative to 100 parts by mass of the non-crystalline polyester resin (the binder resin). The ester wax in the toner particles has a dispersion diameter of at least 500 nm and no greater than 1,000 nm. Preferably, the releasing agent contained in the toner mother particles is substantially only an ester wax, in order to control releasability of the toner easily and reliably.

Particularly preferably, the ester wax is a synthetic ester wax. The use of a synthetic ester wax as a releasing agent allows easy adjustment of the melting point of the releasing agent to within a desired range. The synthetic ester wax can for example be synthesized through a reaction of an alcohol and a carboxylic acid (or a carboxylic acid halide) in the presence of an acid catalyst. The raw materials of the synthetic ester wax may for example be derived from natural products (for example, a long-chain fatty acid produced from a natural oil or fat) or may be commercially available synthetic products.

(Charge Control Agent)

The toner mother particles may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner mother particles can be increased through the toner mother particles containing a negatively chargeable charge control agent (specific examples include organic metal complexes and chelate compounds). The cationic strength of the toner mother particles can be increased through the toner mother particles containing a positively chargeable charge control agent (specific examples include pyridine, nigrosine, and quaternary ammonium salts). However, when it is ensured that the toner has sufficient chargeability, the toner mother particles do not need to contain a charge control agent.

(Magnetic Powder)

The toner mother particles may contain a magnetic powder. Examples of materials of the magnetic powder that can be preferably used include ferromagnetic metals (specific examples include iron, cobalt, nickel, and alloys of any one or two of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

(External Additive)

An external additive (more specifically, a powder including a plurality of external additive particles) may be caused to adhere to the surfaces of the toner mother particles. Unlike internal additives, the external additive is not to be present inside of the toner mother particles but to be selectively present only on the surfaces of the toner mother particles (surfaces of the toner particles). For example, the toner mother particles (powder) and the external additive (powder) are stirred together, so that the external additive particles adhere to the surfaces of the toner mother particles. The toner mother particles and the external additive particles do not react with one another and are physically, not chemically, connected to one another. Strength of the connection between the toner mother particles and the external additive particles can be adjusted depending on stirring conditions (specific examples include stirring time and rotational speed for stirring), the particle diameter of the external additive particles, the shape of the external additive particles, and a surface condition of the external additive particles.

In order to allow the external additive to sufficiently exhibit its function while preventing detachment of the external additive particles from the toner particles, the amount of the external additive (in a situation in which plural types of external additive particles are used, a total amount of the external additive particles) is preferably at least 0.5 part by mass and no greater than 10 parts by mass relative to 100 parts by mass of the toner mother particles.

External additive particles are preferably inorganic particles, and particularly preferably silica particles or particles of a metal oxide (specific examples include alumina, titanium oxide, magnesium oxide, zinc oxide, strontium titanate, and barium titanate). In order to improve fluidity of the toner, inorganic particles (powder) having a number average primary particle diameter of at least 5 nm and no greater than 30 nm are preferably used as the external additive particles. Alternatively or additionally, particles of an organic acid compound such as a fatty acid metal salt (specific examples include zinc stearate) or resin particles may be used as the external additive particles. Alternatively or additionally, composite particles, which are particles of a composite of a plurality of materials, may be used as the external additive particles. One type of external additive particles may be used independently, or a plurality of different types of external additive particles may be used in combination.

The external additive particles may be surface-treated. For example, in a situation in which silica particles are used as the external additive particles, either or both of hydrophobicity and positive chargeability may be imparted to surfaces of the silica particles using a surface treatment agent. Examples of surface treatment agents that can be preferably used include coupling agents (specific examples include silane coupling agents, titanate coupling agents, and aluminate coupling agents), silazane compounds (specific examples include chain silazane compounds and cyclic silazane compounds), and silicone oils (specific examples include dimethylsilicone oil). Particularly preferably, the surface treatment agent is a silane coupling agent or a silazane compound. Examples of preferable silane coupling agents include silane compounds (specific examples include methyltrimethoxysilane and aminosilane). Examples of preferable silazane compounds include HMDS (hexamethyldisilazane). When a surface of a silica base (untreated silica particle) is treated with the surface treatment agent, a large number of hydroxyl groups (—OH) on the surface of the silica base are partially or entirely replaced by functional groups derived from the surface treatment agent. As a result, silica particles having the functional groups derived from the surface treatment agent (specifically, functional groups that are more hydrophobic and/or more readily positively chargeable than the hydroxyl groups) on surfaces thereof are obtained.

EXAMPLES

The following describes Examples of the present disclosure. Table 1 shows toners (electrostatic latent image developing toners) TA-1 to TA-8 and TB-1 to TB-14 according to Examples and Comparative Examples. In Table 1, "Non-crystalline PES" indicates non-crystalline polyester resin, "crystalline PES" indicates crystalline polyester resin, and "S-Ac resin" indicates styrene-acrylic acid-based resin. Table 2 shows S-Ac resins (styrene-acrylic acid-based resins) A to D used in production of the toners.

TABLE 1

| | Binder resin | | | | Releasing agent | |
|---|---|---|---|---|---|---|
| | Non-crystalline PES | Crystalline PES | S-Ac resin | | Amount | |
| Toner | Amount [parts by mass] | Amount [parts by mass] | Type | Amount [parts by mass] | [parts by mass] | Dispersion diameter [nm] |
| TA-1 | 100 | 30 | A | 50 | 15 | 850 |
| TA-2 | 100 | 30 | A | 50 | 8 | 600 |
| TA-3 | 100 | 30 | B | 50 | 15 | 880 |
| TA-4 | 100 | 30 | B | 50 | 8 | 600 |
| TA-5 | 100 | 10 | A | 30 | 15 | 730 |
| TA-6 | 100 | 10 | A | 30 | 8 | 740 |
| TA-7 | 100 | 10 | B | 30 | 15 | 960 |
| TA-8 | 100 | 10 | B | 30 | 8 | 720 |
| TB-1 | 100 | 35 | C | 50 | 15 | 1800 |
| TB-2 | 100 | 30 | B | 50 | 16 | 1920 |
| TB-3 | 100 | 30 | D | 50 | 8 | 420 |
| TB-4 | 100 | 30 | A | 55 | 15 | 2120 |
| TB-5 | 100 | 30 | A | 30 | 7 | 550 |
| TB-6 | 100 | 30 | C | 30 | 8 | 1200 |
| TB-7 | 100 | 30 | B | 25 | 8 | 1280 |
| TB-8 | 100 | 10 | B | 50 | 16 | 2320 |
| TB-9 | 100 | 10 | D | 50 | 8 | 460 |
| TB-10 | 100 | 10 | A | 55 | 15 | 2040 |
| TB-11 | 100 | 10 | A | 30 | 7 | 540 |
| TB-12 | 100 | 10 | C | 30 | 8 | 1120 |
| TB-13 | 100 | 10 | B | 25 | 8 | 1240 |
| TB-14 | 100 | 5 | D | 25 | 8 | 920 |

TABLE 2

| S—Ac resin | Amino group ratio [%] |
|---|---|
| A | 60 |
| B | 40 |
| C | 70 |
| D | 30 |

The following describes, in order, production methods, evaluation methods, and evaluation results of the toners TA-1 to TA-8 and TB-1 to TB-14. In evaluations in which errors might occur, an evaluation value was calculated by calculating an arithmetic mean of an appropriate number of measured values in order to ensure that any errors were sufficiently small.

[Preparation of Materials]

(Synthesis of Non-Crystalline Polyester Resin)

First, glycerin was obtained through hydrolysis of palm oil, which is a vegetable oil. More specifically, palm oil and an aqueous sodium hydroxide solution having a concentration of 10% by mass in an amount twice an amount necessary to cause complete saponification of the palm oil were added into a reaction vessel. Next, the vessel contents were heated at 150° C. to cause complete saponification of the palm oil (vegetable oil). After the saponification, an aqueous glycerin solution was separated from the vessel contents, and the thus obtained aqueous glycerin solution was distilled. Glycerin obtained through the distillation was subjected to an activated carbon treatment to purify the glycerin.

Next, 200 g of ethylene glycol and 76 g of cupric nitrate trihydrate were added into a reaction vessel equipped with a reflux condenser. Next, the vessel contents were heated at 80° C. for 2 hours under stirring. Subsequently, 52 g of tetraethoxysilane was dripped into the vessel, and the vessel contents were heated at 80° C. for 2 hours under stirring. Thereafter, 18 g of water was dripped into the vessel, and then the vessel contents were stirred at 80° C. for 3 hours to yield a precipitate in the vessel. The thus obtained precipitate was dried at 120° C., and subsequently calcined in air at 400° C. for 2 hours to yield a copper/silica catalyst (copper content: 50% by mass). An aqueous solution containing 29.8 mg of tetraammineplatinum (II) nitrate $[Pt(NH_3)_4(NO_3)_2]$ was added to 3 g of the thus obtained copper/silica catalyst, followed by evaporation to dryness in a rotary evaporator. The resultant solid was dried at 120° C., and subsequently calcined in air at 400° C. for 2 hours to yield a copper-platinum/silica catalyst having a copper content of 50% by mass (mass ratio: Cu/Pt/Si=50/0.5/17).

Next, 2 g of the copper-platinum/silica catalyst obtained as described above and 200 g of the glycerin obtained as described above (purified glycerin) were added into a 500-mL steel autoclave equipped with a stirrer. Subsequently, the air in the autoclave was replaced with hydrogen. Next, the internal temperature of the autoclave was raised up to 230° C. to cause the materials (liquids) in the autoclave to react for 7 hours while introducing hydrogen gas into the autoclave at a rate of 5L/minute under conditions of a hydrogen ($H_2$) atmosphere, a pressure of 2 MPa, and a temperature of 25° C., thereby yielding a reaction product (liquid). The resultant reaction product was purified by a standard method to yield plant-derived 1,2-propanediol.

A 5-L four-necked flask equipped with a stirrer ("SM-104", product of AS ONE Corporation), a nitrogen inlet tube, a thermocouple, a drainage tube, and a rectification column was used as a reaction vessel. Into the reaction vessel, 1,142 g of the plant-derived 1,2-propanediol (alcohol component) prepared as described above, 1,743 g of terephthalic acid (carboxylic acid component), and 4 g of tin (II) dioctanoate (condensation catalyst) were added. The vessel contents were caused to react at 230° C. for 15 hours under a nitrogen atmosphere at ambient pressure while removing water generated through the reaction. Thereafter, the internal pressure of the vessel was reduced to 8.3 kPa, and the vessel contents were caused to further react for 1 hour under conditions of a pressure of 8.3 kPa and a temperature of 230° C.

Next, the internal pressure of the vessel was returned to ambient pressure, and the internal temperature of the vessel was reduced to 180° C. Subsequently, 288 g of trimellitic anhydride was added into the vessel. Next, the internal temperature of the vessel was raised up to 210° C. at a rate of 10° C/hour. Subsequently, the vessel contents were caused to further react for 10 hours at ambient pressure at 210° C. Next, the internal pressure of the vessel was reduced to 20 kPa, and the vessel contents were caused to further react for 1 hour under conditions of a pressure of 20 kPa and a temperature of 230° C.

After completion of the reaction, the vessel contents were taken out and cooled. As a result, a non-crystalline polyester resin having a softening point (Tm) of 142° C., a melting point (Mp) of 65° C., and a crystallinity index (=Tm/Mp) of 2.2 was obtained.

(Synthesis of Crystalline Polyester Resin)

Into a 5-L four-necked flask equipped with a thermometer (thermocouple), a drainage tube, a nitrogen inlet tube, and a stirrer, 990 g of 1,4-butanediol (alcohol component), 242 g of 1,6-hexanediol (alcohol component), 1,480 g of fumaric acid (acid component), and 2.5 g of 1,4-benzenediol were added. Next, the flask contents were caused to react at 170° C. for 5 hours. Subsequently, the flask contents were caused to react at 210° C. for 1.5 hours. Subsequently, the flask contents were caused to react for 1 hour under a reduced pressure atmosphere (pressure 8 kPa) at 210° C. Next, an ambient pressure atmosphere was regained, and 69 g of styrene (styrene-acrylic acid-based component) and 54 g of n-butyl methacrylate (styrene-acrylic acid-based component) were added into the flask. Next, the flask contents were caused to react at 210° C. for 1.5 hours. Subsequently, the flask contents were caused to react for 1 hour under a reduced pressure atmosphere (pressure 8 kPa) at 210° C. As a result, a crystalline polyester resin having a softening point (Tm) of 88.8° C., a melting point (Mp) of 82.0° C., a crystallinity index (=Tm/Mp) of 1.08, an acid value of 3.1 mgKOH/g, a hydroxyl value of 19 mgKOH/g, an Mw of 27,500, and an Mn of 3,620 was obtained.

(Synthesis of Cross-Linked Styrene-Acrylic Acid-Based Resin)

Into a reaction vessel equipped with a stirrer and a thermometer, 5,058 g of ion exchanged water, 22 g of a dispersant, 14 g of sodium sulfate, and 60 g of a defoaming agent (polyoxyalkylene pentaerythritol ether: "DISFOAM (registered Japanese trademark) CE-457", product of NOF Corporation) were added. Next, 6,740 g of aminoethyl acrylate, 2,136 g of styrene, 10 g of a cross-linking agent (divinylbenzene having a purity of 56.5%), 75 g of a polymerization initiator (BPO: benzoyl peroxide), and 14 g of t-butylperoxy-2-ethylhexyl monocarbonate ("TRIGONOX (registered Japanese trademark) 117", product of Kayaku Akzo Corporation) were added. The temperature of the vessel contents was 40° C. Next, the temperature of the vessel contents was raised from 40° C. to 130° C. over 65 minutes while the vessel contents were stirred. Once the temperature of the vessel contents reached 130° C., the vessel contents were caused to react for 2 hours (more specifically, polymerization reaction of the vessel contents was promoted). Thereafter, the vessel contents were cooled to yield a dispersion containing a cross-linked styrene-acrylic acid-based resin. The thus obtained dispersion was filtered (solid-liquid separation) through a metal mesh having a pore size of 2 mm to collect resin particles (powder). Next, nylon filter cloth was used to remove fines from the collected resin particles (powder). Thereafter, a washing process and a drying process were performed to yield a cross-linked styrene-acrylic acid-based resin (S-Ac resin A). The S-Ac resins (cross-linked styrene-acrylic acid-based resins) B to D were obtained according to the same method as the synthesis of the S-Ac resin A in all aspects other than that the monomer blending ratio (aminoethyl acrylate/styrene) was changed so as to give the respective values of the amino group ratio shown in Table 2.

The amino group ratio in the S-Ac resins (cross-linked styrene-acrylic acid-based resins) A to D obtained as described above was measured, and results of the measurement are shown in Table 2. For example, the S-Ac resin A had an amino group ratio of 60%. The amino group ratio was measured according to a method described below.

<Measurement Method of Amino Group Ratio>

A Fourier-transform infrared spectrometer (FT-IR) ("Frontier", product of PerkinElmer Co., Ltd.) was used as a measuring device. The measurement was carried out in an attenuated total reflection (ATR) mode. Diamond (refractive index 2.4) was used as the ATR crystal.

The ATR crystal was attached to the measuring device, and 1 mg of a sample (any one of the S-Ac resins A to D) was placed on the ATR crystal. Next, the sample was pressed at a load of at least 60 N and no greater than 80 N using a pressure arm of the measuring device. Subsequently, an FT-IR spectrum of the sample was measured under a condition of an infrared light incidence angle of 45°. An intensity of a peak from the aromatic ring and an intensity of a peak from the amino group were determined from the resultant FT-IR spectrum. Subsequently, the amino group ratio (ratio of the intensity of the peak from the amino group to the intensity of the peak from the aromatic ring) was calculated.

[Toner Production Method]

(Preparation of Toner Mother Particles)

An FM mixer ("FM-20B", product of Nippon Coke & Engineering Co., Ltd.) was used to mix 100 parts by mass of the non-crystalline polyester resin (the non-crystalline polyester resin obtained as described above), the crystalline polyester resin (the crystalline polyester resin obtained as described above) in an amount shown in Table 1, a cross-linked styrene-acrylic acid-based resin (an appropriate one of the S-Ac resins A to D specified in Table 1 for the respective toners) in an amount shown in Table 1, a synthetic ester wax ("NISSAN ELECTOR (registered Japanese trademark) WEP-9", product of NOF Corporation) in an amount shown in Table 1, 5 parts by mass of carbon black ("MA-100", product of Mitsubishi Chemical Corporation), and 1 part by mass of a quaternary ammonium salt ("BONTRON (registered Japanese trademark) P-51", product of ORIENT CHEMICAL INDUSTRIES, Co., Ltd.). For example, in production of Toner TA-1, 100 parts by mass of the non-crystalline polyester resin as described above, 30 parts by mass of the crystalline polyester resin as described above, 50 parts by mass of the cross-lined styrene-acrylic acid-based resin (the S-Ac resin A), 15 parts by mass of the ester wax (NISSAN ELECTOR WEP-9), 5 parts by mass of carbon black (MA-100), and 1 part by mass of the quaternary ammonium salt (BONTRON P-51) were mixed.

Next, the resultant mixture was melt-kneaded using a twin screw extruder ("PCM-30", product of Ikegai Corp.). Thereafter, the resultant kneaded product was cooled. The kneaded product (after cooling) was used as an evaluation target in pulverizing performance evaluation described below.

After cooling, the kneaded product was coarsely pulverized using a pulverizer ("ROTOPLEX" (registered Japanese trademark)" product of Hosokawa Micron Corporation). Next, the resultant coarsely pulverized product was finely pulverized using a pulverizer ("Turbo Mill model RS", product of FREUND-TURBO CORPORATION). Next, the resultant finely pulverized product was classified using a classifier ("Elbow Jet EJ-LABO", product of Nittetsu Mining Co., Ltd.). As a result, toner mother particles having a volume median diameter of 7 μm were obtained.

(External Additive Addition Process)

An FM mixer ("FM-10B", product of Nippon Coke & Engineering Co., Ltd.) was used to mix 100 parts by mass of the toner mother particles, 1.2 parts by mass of fine hydrophobic silica particles ("AEROSIL (registered Japanese trademark) RA-200H", product of Nippon Aerosil Co., Ltd., dry silica particles surface-modified with a trimethylsilyl group and an amino group, number average primary particle diameter: approximately 12 nm), and 0.8 parts by mass of fine conductive titanium oxide particles ("EC-100", product of Titan Kogyo, Ltd., substrate: $TiO_2$ particles, coat layer: Sb doped $SnO_2$ films, number average primary particle diameter: approximately 0.35 μm) for 2 minutes at a rotational speed of 3,000 rpm and a jacket temperature of 20° C. Through the above, the external additive adhered to the surfaces of the toner mother particles. Next, sifting was performed using a 300-mesh sieve (pore size 48 μm). As a result, a toner (among the toners TA-1 to TA-8 and TB-1 to TB-14) including a plurality of toner particles was obtained.

With respect to each of the toners TA-1 to TA-8 and TB-1 to TB-14 obtained as described above, the dispersion diameter of the releasing agent (ester wax) in the toner particles was measured. Table 1 shows the measurement results. For example, with respect to the toner TA-1, the releasing agent had a dispersion diameter of 850 nm. The dispersion diameter of the releasing agent was measured according to a method described below.

<Releasing Agent Dispersion Diameter>

A sample (toner) was dispersed in a cold-setting epoxy resin and left to stand for 2 days at an ambient temperature of 40° C. to yield a hardened material. The resultant hardened material was dyed in osmium tetroxide, and subsequently a flake sample having a thickness of 250 μm was cut therefrom using an ultramicrotome ("EM UC6", product of Leica Microsystems) equipped with a diamond knife. Next, an image of a cross-section of the flake sample (particularly, a cross-section of a toner mother particle) was captured using a scanning electron microscope (SEM) ("JSM-7401F", product of JEOL Ltd., type: FE-SEM, FE electron source: a conical electron gun). Next, the SEM image (the image of the cross-section of the toner particle) was analyzed using image analysis software ("WinROOF", product of Mitani Corporation) thereby to measure the dispersion diameter (equivalent circle diameter) of the releasing agent (ester wax).

A number average dispersion diameter of releasing agent domains (ester wax domains) in the cross-section of the toner particle was calculated. More specifically, dispersion diameter measurement values of 100 releasing agent domains were obtained per image of a cross-section of one toner particle, and a number average dispersion diameter of the releasing agent domains in the cross-section of the toner particle was calculated based on the thus obtained 100 measurement values. Furthermore, such a number average dispersion diameter of releasing agent domains was obtained for cross-sections of 100 toner particles included in the sample (toner), and an arithmetic mean of the thus obtained 100 values was used as an evaluation value (releasing agent dispersion diameter) of the toner.

[Evaluation Methods]

Each of samples (the toners TA-1 to TA-8 and TB-1 to TB-14) was evaluated in accordance with methods described below.

(Degree of Toner Aggregation)

A 20-mL polyethylene container was charged with 20 g of the sample (toner), and a stress of 0.01 kgf/mm$^2$ was applied to the toner. With a stress of 0.01 kgf/mm$^2$ being applied to the toner in the container, the container was left to stand for 3 hours in a thermostatic chamber set at 25° C. Thereafter, the toner was taken out of the thermostatic chamber and used as an evaluation toner.

Next, the thus obtained evaluation toner was placed on a 200-mesh sieve of known mass. The mass of the toner on the sieve (mass of toner before sifting) was calculated by measuring the total mass of the sieve and the evaluation toner thereon. Next, the sieve was placed in a powder tester (product of Hosokawa Micron Corporation) and the evaluation toner was sifted in accordance with a manual of the powder tester by shaking the sieve for 30 seconds at a rheostat level of 5. After shifting, a mass of the toner that did not pass through the sieve (toner remaining on the sieve) was measured. Based on the mass of the toner before sifting and the mass of the toner after shifting (the mass of the toner that did not pass through the sieve), a degree of toner aggregation (unit: % by mass) was calculated in accordance with the following equation.

$$\text{Degree of toner aggregation} = 100 \times \text{Mass of toner after shifting}/\text{Mass of toner before shifting}$$

A degree of toner aggregation of no greater than 20% by mass was evaluated as "Good". A degree of toner aggregation of greater than 20% by mass was evaluated as "Not Good".

(Low-Temperature Fixability and Hot Offset Resistance)

A ball mill was used to mix 100 parts by mass of a developer carrier (carrier for FS-05200DN) and 5 parts by mass of the sample (toner) for 30 minutes to prepare a two-component developer.

A printer ("FS-05250DN", product of KYOCERA Document Solutions Inc., modified to enable adjustment of fixing temperature) having a roller-roller type heat-pressure fixing device was used as an evaluation apparatus. The two-component developer prepared as described above was loaded into a developing device of the evaluation apparatus, and the sample (toner for replenishment use) was loaded into a toner container of the evaluation apparatus.

The evaluation apparatus was used to form a solid image (more specifically, an unfixed toner image) having a size of 25 mm×25 mm on evaluation paper ("COLOR COPY (registered Japanese trademark)", product of Mondi, A4 size, basis weight 90 g/m$^2$) under conditions of a linear velocity of 105 mm/second and a toner application amount of 1.3 mg/cm$^2$. Next, the paper with the image formed thereon was passed through the fixing device of the evaluation apparatus.

The fixing temperature was set to within a range of from 100° C. to 150° C. to evaluate a minimum fixable temperature. More specifically, the fixing temperature of the fixing device was reduced in increments of a specific temperature from 150° C. to determine whether or not the solid image (toner image) was fixable at each fixing temperature. Thus, a minimum temperature at which the toner was fixable to the paper (a minimum fixable temperature) was measured. Determination of whether or not the toner was fixable was carried out through a fold-rubbing test described below. The evaluation paper passed through the fixing device was folded in half with a surface on which the image was formed facing inward and a 1 kg brass weight covered with cloth was rubbed back and forth on the fold with the image five times. Next, the paper was opened up and a fold portion (i.e., a portion on which the solid image was formed) of the paper was observed. The length of toner peeling of the fold portion (peeling length) was measured. The minimum fixable temperature was determined to be the lowest temperature among fixing temperatures for which the peeling length was no greater than 1 mm. Low-temperature fixability was evaluated as "Good" if the minimum fixable temperature was no greater than 130° C. and evaluated as "Poor" if the minimum fixable temperature was greater than 130° C.

A maximum fixable temperature was also measured within a fixing temperature range of from 150° C. to 250° C. More specifically, the fixing temperature of the fixing device was increased in increments of 2° C. from 150° C. to determine whether or not offset occurred at each fixing temperature. Thus, a maximum temperature at which offset did not occur (maximum fixable temperature) was measured. Determination of whether or not offset occurred was carried out through visual observation on the evaluation paper passed through the fixing device. More specifically, it was determined that offset had occurred if staining resulting from toner adhering to a fixing roller was observed on the evaluation paper. Hot offset resistance was evaluated as "Good" if the maximum fixable temperature was at least 200° C. and evaluated as "Poor" if the maximum fixable temperature was less than 200° C.

[Evaluation Results]

Table 3 shows evaluation results of the samples (the toners TA-1 to TA-8 and TB-1 to TB-14). Table 3 shows results of the evaluations of the low-temperature fixability (minimum fixable temperature), the hot offset resistance (maximum fixable temperature), and the degree of toner aggregation.

TABLE 3

| | Toner | Low-temperature fixability [° C.] | Hot offset resistance [° C.] | Degree of toner aggregation [% by mass] |
|---|---|---|---|---|
| Example 1 | TA-1 | 120 | 220 | 18 |
| Example 2 | TA-2 | 122 | 212 | 10 |
| Example 3 | TA-3 | 122 | 220 | 16 |
| Example 4 | TA-4 | 122 | 208 | 12 |
| Example 5 | TA-5 | 125 | 218 | 15 |
| Example 6 | TA-6 | 127 | 208 | 9 |
| Example 7 | TA-7 | 126 | 218 | 8 |
| Example 8 | TA-8 | 128 | 210 | 15 |
| Comparative Example 1 | TB-1 | 133 (Poor) | 220 | 42 (Not Good) |
| Comparative Example 2 | TB-2 | 136 (Poor) | 218 | 60 (Not Good) |
| Comparative Example 3 | TB-3 | 122 | 198 (Poor) | 12 |
| Comparative Example 4 | TB-4 | 135 (Poor) | 216 | 44 (Not Good) |
| Comparative Example 5 | TB-5 | 125 | 196 (Poor) | 18 |
| Comparative Example 6 | TB-6 | 123 | 210 | 36 (Not Good) |
| Comparative Example 7 | TB-7 | 127 | 210 | 45 (Not Good) |
| Comparative Example 8 | TB-8 | 138 (Poor) | 218 | 62 (Not Good) |
| Comparative Example 9 | TB-9 | 127 | 194 (Poor) | 19 |
| Comparative Example 10 | TB-10 | 136 (Poor) | 218 | 52 (Not Good) |
| Comparative Example 11 | TB-11 | 129 | 196 (Poor) | 14 |
| Comparative Example 12 | TB-12 | 127 | 212 | 35 (Not Good) |
| Comparative Example 13 | TB-13 | 128 | 210 | 41 (Not Good) |
| Comparative Example 14 | TB-14 | 141 (Poor) | 208 | 18 |

Each of the toners TA-1 to TA-8 (the toner according to Examples 1 to 8) had the above-described feature. More specifically, the toner particles of each of the toners TA-1 to TA-8 contained a non-crystalline polyester resin and an ester wax (see Table 1). The toner particles of each of the toners TA-1 to TA-8 further contained at least 10 parts by mass and no greater than 30 parts by mass of a crystalline polyester resin and at least 30 parts by mass and no greater than 50 parts by mass of a styrene-acrylic acid-based resin relative to 100 parts by mass of the non-crystalline polyester resin (see Table 1). The crystalline polyester resin included the first repeating unit derived from an acrylic acid-based monomer and the second repeating unit derived from a styrene-based monomer (see the section of "Synthesis of Crystalline Polyester Resin" above). The styrene-acrylic acid-based resin included the third repeating unit derived from an acrylic acid-based monomer having an amino group and the fourth repeating unit derived from a styrene-based monomer. The amino group ratio in the styrene-acrylic acid-based resin (ratio of the intensity of the peak from the amino group of the third repeating unit to the intensity of the peak from the aromatic ring of the fourth repeating unit on the FT-IR spectrum of the toner measured by the ATR method) was at least 40% and no greater than 60% (see Tables 1 and 2). The amount of the ester wax in the toner particles was at least 8 parts by mass and no greater than 15 parts by mass relative to 100 parts by mass of the non-crystalline polyester resin (see Table 1). The ester wax (releasing agent) in the toner particles had a dispersion diameter of at least 500 nm and no greater than 1,000 nm (see Table 1).

As shown in Table 3, the toners TA-1 to TA-8 showed excellent results in the low-temperature fixability evaluation, the hot offset resistance evaluation, and the degree of toner aggregation evaluation.

The toner TB-1 (the toner according to Comparative Example 1) showed poor results in the low-temperature fixability evaluation and the degree of toner aggregation evaluation compared to the toners TA-1 to TA-8. It is thought that the amount of the crystalline polyester resin was so large that dispersibility of the toner components (internal additives) was reduced.

The toner TB-2 (the toner according to Comparative Example 2) showed poor results in the low-temperature fixability evaluation and the degree of toner aggregation evaluation compared to the toners TA-1 to TA-8. It is thought that the amount of the releasing agent was so large that shear stress was insufficient during kneading of the toner components (the binder resin and the internal additives).

The toner TB-3 (the toner according to Comparative Example 3) showed a poor result in the hot offset resistance evaluation compared to the toners TA-1 to TA-8. It is thought that the amino group ratio in the styrene-acrylic acid-based resin was so small that compatibility between the binder resin and the ester wax (releasing agent) was excessively high (and thus the dispersion diameter of the releasing agent was excessively small).

The toner TB-4 (the toner according to Comparative Example 4) showed poor results in the low-temperature fixability evaluation and the degree of toner aggregation evaluation compared to the toners TA-1 to TA-8. It is thought that the amount of the styrene-acrylic acid-based resin was so large that dispersibility of the toner components (internal additives) was reduced.

The toner TB-5 (the toner according to Comparative Example 5) showed a poor result in the hot offset resistance evaluation compared to the toners TA-1 to TA-8. It is thought that the amount of the releasing agent was so small that releasability of the toner was insufficient.

The toner TB-6 (the toner according to Comparative Example 6) showed a poor result in the degree of toner aggregation evaluation compared to the toners TA-1 to TA-8. It is thought that the amino group ratio in the styrene-acrylic acid-based resin was so large that compatibility between the binder resin and the ester wax (releasing agent) was insufficient, and thus the dispersion diameter of the releasing agent was excessively large.

The toner TB-7 (the toner according to Comparative Example 7) showed a poor result in the degree of toner aggregation evaluation compared to the toners TA-1 to TA-8. It is thought that the amount of the styrene-acrylic acid-based resin was so small that the dispersion diameter of the releasing agent was excessively large.

The toner TB-8 (the toner according to Comparative Example 8) showed poor results in the low-temperature fixability evaluation and the degree of toner aggregation evaluation compared to the toners TA-1 to TA-8. It is thought that the amount of the releasing agent was so large that dispersibility of the toner components (internal additives) was reduced.

The toner TB-9 (the toner according to Comparative Example 9) showed a poor result in the hot offset resistance evaluation compared to the toners TA-1 to TA-8. It is thought that the amino group ratio in the styrene-acrylic acid-based resin was so small that compatibility between the binder resin and the ester wax (releasing agent) was excessively high (and thus the dispersion diameter of the releasing agent was excessively small).

The toner TB-10 (the toner according to Comparative Example 10) showed poor results in the low-temperature fixability evaluation and the degree of toner aggregation evaluation compared to the toners TA-1 to TA-8. It is thought that the amount of the styrene-acrylic acid-based resin was so large that dispersibility of the toner components (internal additives) was reduced.

The toner TB-11 (the toner according to Comparative Example 11) showed a poor result in the hot offset resistance evaluation compared to the toners TA-1 to TA-8. It is thought that the amount of the releasing agent was so small that releasability of the toner was insufficient.

The toner TB-12 (the toner according to Comparative Example 12) showed a poor result in the degree of toner aggregation evaluation compared to the toners TA-1 to TA-8. It is thought that the amino group ratio in the styrene-acrylic acid-based resin was so large that compatibility between the binder resin and the ester wax (releasing agent) was insufficient, and thus the dispersion diameter of the releasing agent was excessively large.

The toner TB-13 (the toner according to Comparative Example 13) showed a poor result in the degree of toner aggregation evaluation compared to the toners TA-1 to TA-8. It is thought that the amount of the styrene-acrylic acid-based resin was so small that the dispersion diameter of the releasing agent was excessively large.

The toner TB-14 (the toner according to Comparative Example 14) showed a poor result in the low-temperature fixability evaluation compared to the toners TA-1 to TA-8. It is thought that the amount of the crystalline polyester resin was so small that it was impossible to ensure sufficient low-temperature fixability of the toner.

What is claimed is:

1. A toner comprising a plurality of toner particles containing a non-crystalline polyester resin and an ester wax, wherein the toner particles further contain at least 10 parts by mass and no greater than 30 parts by mass of a crystalline polyester resin and at least 30 parts by mass and no greater than 50 parts by mass of a first resin relative to 100 parts by mass of the non-crystalline polyester resin, the crystalline polyester resin includes a first repeating unit derived from an alkyl (meth)acrylate and a second repeating unit derived from styrene, the first resin includes a third repeating unit derived from an aminoalkyl (meth)acrylate and a fourth repeating unit derived from styrene, an intensity of a peak from an amino group of the third repeating unit is at least 40% and no greater than 60% of an intensity of a peak from an aromatic ring of the fourth repeating unit on an FT-IR spectrum of the toner measured by an attenuated total reflection (ATR) method, an amount of the ester wax in the toner particles is at least 8 parts by mass and no greater than 15 parts by mass relative to 100 parts by mass of the non-crystalline polyester resin, and the ester wax in the toner particles has a dispersion diameter of at least 500 nm and no greater than 1,000 nm.

2. The toner according to claim 1, wherein the first resin is a cross-linked resin.

3. The toner according to claim 2, wherein the first resin being the cross-linked resin is a polymer of styrene, at least one aminoalkyl (meth)acrylate, and at least one cross-linking agent.

4. The toner according to claim 3, wherein the crystalline polyester resin is a polymer of at least one $\alpha,\omega$-alkanediol, at least one dibasic carboxylic acid, styrene, and at least one alkyl (meth)acrylate.

5. The toner according to claim 4, wherein the non-crystalline polyester resin is a polymer of 1,2-propanediol, at least one aromatic dicarboxylic acid, and at least one tribasic carboxylic acid.

6. The toner according to claim 5, wherein the first resin being the cross-linked resin is a polymer of styrene, aminoethyl acrylate, and divinylbenzene, the crystalline polyester resin is a polymer of 1,4-butanediol, 1,6-hexanediol, fumaric acid, styrene, and n-butyl methacrylate, and the non-crystalline polyester resin is a polymer of 1,2-propanediol, terephthalic acid, and trimellitic acid.

* * * * *